United States Patent [19]

Huet

[11] 4,089,050

[45] May 9, 1978

[54] DEVICE FOR CONTINUOUSLY MIXING A POWDER IN A LIQUID

[75] Inventor: Joël Huet, Vernon, France

[73] Assignee: The Societe Dilumelt, Vernon, France

[21] Appl. No.: 723,701

[22] Filed: Sep. 16, 1976

Related U.S. Application Data

[62] Division of Ser. No. 523,153, Nov. 12, 1974, Pat. No. 4,002,324.

[30] Foreign Application Priority Data

Mar. 20, 1974 France ..... 74 09512

[51] Int. Cl.[2] ..... B01F 7/04; B01F 15/02

[52] U.S. Cl. ..... 366/181; 366/183

[58] Field of Search ..... 259/4 R, 5, 6, 7, 8, 259/9, 10, 97, DIG. 30, 25, 26, 45, 46, 21

[56] References Cited

U.S. PATENT DOCUMENTS

| | | | |
|---|---|---|---|
| 2,653,801 | 9/1953 | Fontein | 259/4 R |
| 2,720,384 | 10/1955 | Gaenzle | 259/7 |
| 2,801,083 | 7/1957 | Balassa | 259/8 |
| 2,953,360 | 9/1960 | Kline | 259/97 |
| 3,140,861 | 7/1964 | Krup | 259/10 |
| 3,273,734 | 9/1966 | Schuler | 259/97 |
| 3,322,684 | 5/1967 | Gibson | 259/10 |
| 3,796,508 | 3/1974 | Rowley | 259/7 |

*Primary Examiner*—Robert W. Jenkins
*Attorney, Agent, or Firm*—Edwin E. Greigg

[57] ABSTRACT

What follows is a description of a device for the dispersion of a powder in a liquid, wherein the powder has a considerable solvation capacity. The device includes a unit for supplying liquid and forming the liquid into a flow passage which envelopes the powder, and an atomization unit for receiving the powder and enveloping liquid to produce the desired dispersion of the powder.

2 Claims, 5 Drawing Figures

DEVICE FOR CONTINUOUSLY MIXING A POWDER IN A LIQUID

This is a Division of application Ser. No. 523,153, filed Nov. 12, 1974, now U.S. Pat. No. 4,002,324.

This invention relates to a device whereby a powdered or finely divided product referred-to hereinafter by the general designation of "powder" is mixed continuously in a liquid. The method according to the invention is particularly advantageous when the powder has a high solvation capacity with respect to said liquid.

Up to the present time, mixing or dispersion of a powder in a liquid had been performed non-continuously by successive stirring operations with addition of a further quantity of liquid between two consecutive mixing periods.

Continuous dispersion tests have been performed by ensuring that the powder and the liquid are fed into a hopper at the same time without taking any special precautions and at discharge ratios equal to that of the desired dispersion, the hopper being located upstream of a gear pump, for example. It has been observed, however, that the powder thus formed lumps which adhered to the hopper and caused progressive clogging of the latter; it then proved necessary to "push" the heterogeneous mass of lumps towards the outlet of the hopper in order to continue the supply of this latter. This method entails the need for constant supervision, results in stoppages of the process and in variations of the dilution ratio.

A large number of methods and devices have been conceived with a view to solving the problem. Most of these methods consist in causing the liquid to run down the walls of a vessel or hopper and in establishing a rapid and uniform contact between this thin layer or film of liquid and the product to be dispersed which is atomized and projected towards the walls of the vessel or hopper, the dispersion being practically completed at the lower ends of said walls. Processes which can be mentioned by way of example are those of the Kurashiki Rayon Company, Iwako and Coal Industry. None of these processes proves wholly satisfactory since they entail the need for complicated equipment and permit only a low dispersion ratio or a very low output rate.

Another design solution is employed in the mixer of the Ladish Company. In this device the mixing operation is carried out within an impeller unit having a vertical axis in which the powder is admitted at the center of the impeller and the liquid is guided within the annular space onto the blades of said impeller, said space being intended to constitute the mixing zone. Disadvantages arise when this mixer is employed for particularly hygroscopic products; on the one hand, lumps are formed at the center of the impeller in spite of any precautions which may be taken and, on the other hand, the arrangement of the impeller calls for horizontal discharge of the mixture which is therefore difficult and sometimes impossible.

In accordance with the invention, it is intended in an initial step to prevent the dry or slightly solvated powder from coming into contact with the walls of the equipment units. In accordance with the method of the invention, this is achieved by interposing between the powder and the walls the liquid film in which the powder is intended to be dispersed. In more exact terms, the liquid is discharged in the form of a layer which is preferably continuous and forms a flow passage and the powder is introduced into the passage formed by said layer; the ratio of flow rate of the powder to flow rate of the liquid is equal to that of the desired dispersion. In a second step, the invention consists in atomizing the liquid layer forming a passage which contains the powder; this atomization is obtained by conventional means such as hammer-type grinders or turbine impellers. It will be noted that, in accordance with the method contemplated by the invention, the supply of liquid must take place at least a short instant prior to the supply of powder at the time of commencement of the dispersion operation.

As an advantageous feature, a partial vacuum is produced at the lower end of the liquid flow passage in order to ensure that the movements of the powder and of the layer of liquid result both from the action of gravity and from suction and that subsequent atomization takes place in an aerated medium.

Disclosed herein is a device for carrying out the method. This device comprises a hopper for receiving the powder, said hopper being provided at the upper portion thereof with a perimeter distributor for the regulated supply of liquid, constituted by at least one perforated ring. Liquid is discharged from the distributor in an overall direction substantially orthogonal to the perimeter thereof at each point of discharge. The supply of powder can be carried out by means of a hopper having a vibratory platform or preferably by means a hopper having a vibratory platform or preferably by means of a hopper which cooperates with a variable-speed worm-screw. As stated in the foregoing, atomization is obtained by means of a hammer-type grinder or by means of an impeller unit. The unit just mentioned makes it possible to create a partial vacuum at the lower end of the liquid flow passage without entailing the need for any additional device.

Further properties of the invention will become apparent from a perusal of the following description and from a study of the accompanying drawings, in which.

Figure 1:
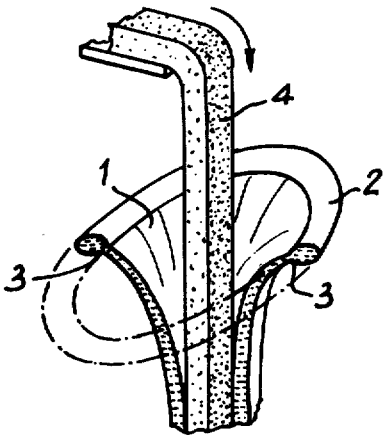
FIG. 1 is a diagram which illustrates the method according to the invention.

As shown in FIG. 1, a layer 1 of liquid having a substantially circular symmetry (in the figure, the layer 1 is cut along a plane containing its axis of symmetry for the sake of enhanced clarity of the description) is generated by a distributor 2 having the shape of a torus and split in the longitudinal direction at 3. This layer constitutes a funnel-shaped flow passage. It must be understood, however, that the liquid flow passage which is a characteristic feature of the invention can assume a number of different shapes, that of a funnel being mentioned only by way of example since it is the simplest shape.

In more general terms, the characteristic feature of the invention lies in the fact that the liquid flow passage has the design function of preventing the powder as designated by the reference 4 from coming into contact with the walls of the devices. Thus the liquid flow passage can perform this function in the same manner if it is formed by a plurality of unitary layers generated by means of a number of substantially coaxial ring distributors provided with non-continuous slits, said unitary layers being so arranged as to overlap in pairs opposite to the path followed by the powder; in an extreme case, said unitary layers can consist of fine jets without thereby modifying the function of the liquid flow passage to an appreciable extent.

Figure 2:
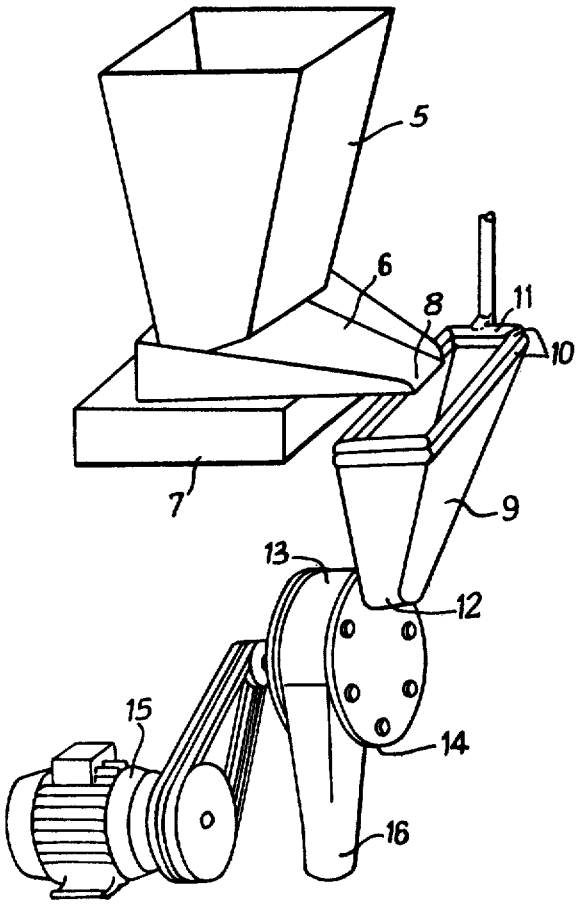
FIG. 2 illustrates a particular device for carrying out the method.

In one example of construction of a dispersion device for carrying out the method according to the invention as shown in FIG. 2, there is incorporated a feed hopper 5 having a delivery or discharge rate which is adjusted in known manner by means of a vibratory platform 6 driven in vibrational motion by a vibrator 7. The chute 8 of said vibratory platform is located directly above a receiving hopper 9, the top portion of which is provided with superposed distributor tubes 10, longitudinal slits 11 being formed in the internal faces of said tubes and so arranged as to overlap opposite to the chute 8 of the platform 6. The lower portion 12 of the receiving hopper 9 opens into the casing 13 of a grinder 14 having stationary hammers and a horizontal axis. A high-speed motor 15 is preferable for driving the grinder. The dispersion of powder within the liquid is collected at 16 after it has passed through a fine-mesh grid which is placed at the periphery of the grinder but is not visible in the drawings. The supply of liquid to the distributor tubes such as the tube 10 at a controlled flow rate can be carried out by means of a constant-level tank (omitted from the drawings) which is mounted to feed the distributor tubes by gravity or by means of automatic flow regulators. Means for delaying start-up of the vibrator 7 and initial supply of liquid for the period of time required to permit running-up to speed of the grinder are incorporated in a control cubicle of the installation (not shown in the drawings).

Figure 3:
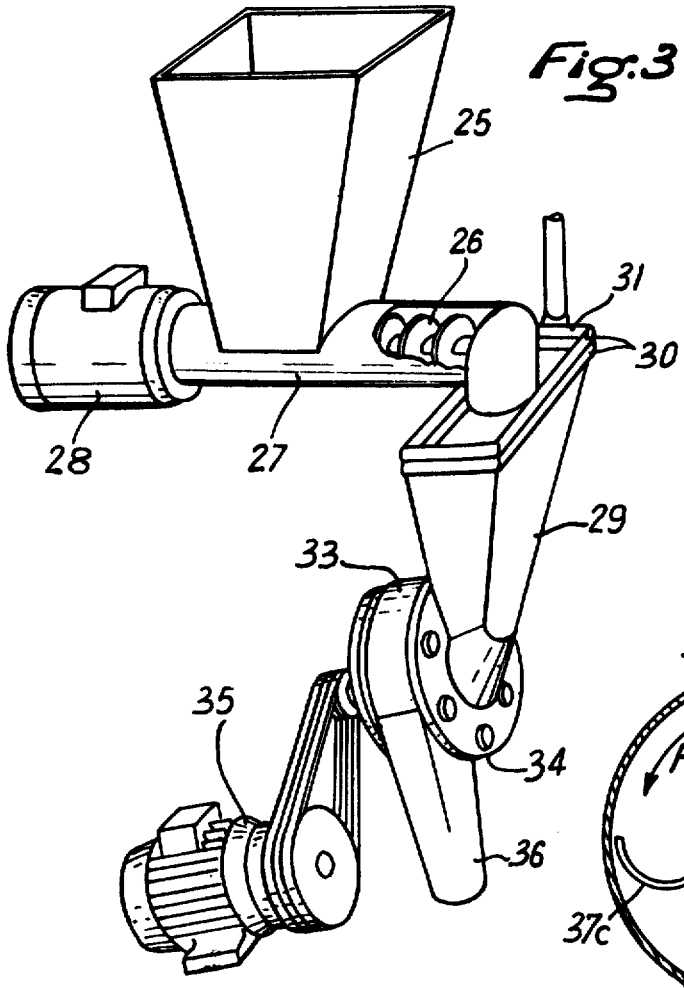
FIG. 3 illustrates the main elements of an alternative form of construction of the device.
Figure 4:
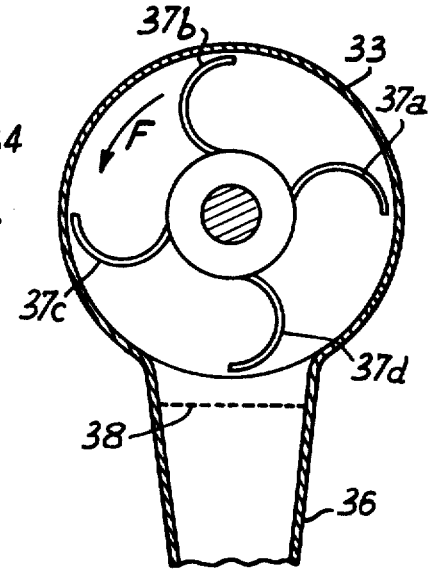
FIG. 4 shows diagrammatically the arrangement of the impeller blades and the position of the discharge grid of the device shown in FIG. 3.

In FIGS. 3 and 4, the dispersion device in accordance with the invention comprises in an alternative form of construction a hopper 25 for the supply of powder, the discharge rate of which is adjusted in known manner by means of a worm-screw 26 placed within a tubular casing 27 and driven in rotation by a variable-speed motor 28. The free end of the tubular casing 27 forms a bend which is directed downwards vertically above a receiving hopper 29. The top portion of said hopper 29 is fitted with superposed distributor tubes 30 provided on the inside of the hopper with longitudinal overlapping slits 31. The lower end of said receiving hopper opens laterally at the center of the casing 33 of an impeller 34 which is driven by a motor 35 and provided in the example shown with four blades **37*a*, 37*b*, 37*c* and 37*d*** which are backwardly curved in a suitable manner.

The axis of rotation of the impeller can be substantially horizontal but is advantageously inclined to the horizontal in order to facilitate the admission of the liquid flow passage without causing rupture of this latter. The angle at which the axis is inclined in the horizontal can attain 20°.

The liquid flow passage which is formed as stated in the foregoing and the powder contained therein are atomized by the impeller blades which rotate in the direction of the arrow F (as shown in FIG. 4) and the dispersion thus obtained is discharged through the spout 36 after having passed through a fine-mesh grid 38.

It is readily apparent that the rotational motion of the impeller blades **37*a* to 37*d* produces a partial vacuum at the bottom of the receiving hopper 29, that is to say at the lower end of the liquid flow passage. The powder and its liquid envelope are thus transported under the combined and simultaneous actions of gravity and suction. This partially pneumatic transfer prevents any loss of powder by dispersion in the atmosphere as it is discharged from the bend of the tubular casing 27 and prevents any "tearing" of the liquid layer along the walls of the hopper 29. In addition, atomization takes place in an aerated medium within the impeller unit 34**.

The grid 38 is placed within the discharge spout 36 and set slightly towards the exterior with respect to the periphery of the casing 33 of the impeller 34. By virtue of this arrangement, a small thickness of product having a paste consistency is permitted to accumulate above said grid. This has the effect of reducing the rate of falling of the paste and in turn promotes homogenization of the dispersion collected at the outlet of the discharge spout 36.

Figure 5:
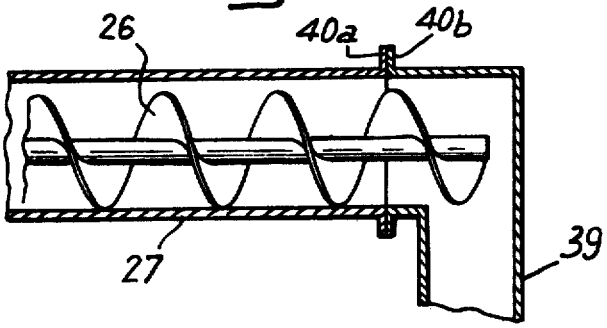
FIG. 5 is a sectional view showing the arrangement of the worm-screw of the device shown in FIG. 3 within its tubular casing and the constructional design of said casing in the form of two elements.

FIG. 5 illustrates a particular arrangement of the worm-screw 26 within its casing 27 and a particular structure of this latter.

In this form of construction, the worm-screw 26 is displaced slightly off-center with respect to the casing 27 in order to be in light contact with the bottom generating-line of said casing, the necessary working clearance being displaced wholly towards the top generating-line (this clearance being purposely exaggerated in FIG. 5 for the sake of enhanced clarity of the drawing). This arrangement results in self-cleaning of the casing 27 since the powder is not liable to accumulate even in a small thickness in the bottom portion of the casing.

Furthermore, the worm-screw 26 which rests on the internal face of the wall of the casing 27 can be mounted in an overhung position at the end remote from the bottom of the hopper 25, that it is to say without any bearing. The vertical return bend 39 can accordingly be constituted by an added component which is attached separately and removably to the substantially horizontal tubular casing 27 by means of corresponding flanges **40*a* and 40*b* and by rapid fastening means, for example. This arrangement has a double advantage. On the one hand, disassembly of the return bend 39 permits easier access to the worm-screw 26 when a change in the type of powder entails the need for careful cleaning of said worm-screw as well as the internal wall of the casing 27. Furthermore, after removal of the return bend 39, it is possible by means of the flange 40*a* to adapt an inclined semi-cylindrical trough (not shown in the drawings) to the outlet of the casing 27. Said trough serves to discharge the powder into a container which is suitably placed at a distance from the discharge position above the receiving hopper 29. It is thus extremely easy to empty the feed hopper 25** at the time of a change of product.

It is readily apparent that modifications can be made in the devices hereinabove described without thereby departing either from the scope or the spirit of the invention. From this it follows that complementary arrangements can be contemplated for controlling such conditions as rates of flow of powder and of liquid, the temperature of the liquid and so forth. Furthermore, the term "grid" is understood to mean any device which performs a function of atomization by impact (reduction of lumps to a finely divided state) and a function of slowing-down the rate of fall of the paste. Excellent results are thus obtained by means of a frame having a plurality of parallel equidistant teeth of small thickness and of sufficient height to guide the paste within the discharge spout.

The present invention finds a field of application in particular in the dispersion of water of polyholosides such as thickening colloids, starch, flour, proteins such as gelatin, albumins, dried milk and the like as well as all substances having an appreciable solvation capacity for the liquid in which they are to be dispersed.

We claim:

1. A device for the dispersion of a powder in a liquid and particularly a powder having a considerable solvation capacity with respect to a liquid in which said powder is intended to be dispersed, comprising a unit for supplying powder, a unit for supplying liquid and forming the liquid into a flow passage for the powder, thereby enveloping the powder received in the passage from the powder supply unit, and an atomization unit for receiving the powder and enveloping liquid, wherein the atomization unit is a blade-type impeller having an axis of rotation which is inclined to the horizontal at an angle within the range of 0° to 20°, the liquid flow passage being admitted at the center of said impeller and the dispersion obtained being discharged from said impeller under the action of gravity.

2. A device according to claim 1, wherein the dispersion is discharged at the outlet of the atomization impeller through a grid which is outwardly displaced to a slight extent with respect to the periphery of the impeller casing so as to ensure that a bed of product having a paste consistency is formed on the top face of said grid.

* * * * *